US011760588B2

(12) United States Patent
Shiba

(10) Patent No.: US 11,760,588 B2
(45) Date of Patent: Sep. 19, 2023

(54) IMAGE FORMING APPARATUS

(71) Applicant: TOSHIBA TEC KABUSHIKI KAISHA, Tokyo (JP)

(72) Inventor: Tetsuo Shiba, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 277 days.

(21) Appl. No.: 17/193,137

(22) Filed: Mar. 5, 2021

(65) Prior Publication Data

US 2022/0281700 A1 Sep. 8, 2022

(51) Int. Cl.
*B65H 1/04* (2006.01)
*B65H 3/06* (2006.01)

(52) U.S. Cl.
CPC ..... *B65H 3/0676* (2013.01); *B65H 1/04* (2013.01); *B65H 3/0669* (2013.01); *B65H 2515/30* (2013.01)

(58) Field of Classification Search
CPC ..... B65H 3/0669; B65H 1/04; B65H 3/06; B65H 7/02; B65H 5/06; B65H 3/0676
USPC ..... 271/161
See application file for complete search history.

(56) References Cited

U.S. PATENT DOCUMENTS

| | | | | |
|---|---|---|---|---|
| 7,614,621 | B2 * | 11/2009 | Asada | B65H 3/0676 271/118 |
| 7,717,414 | B2 * | 5/2010 | Ooshiro | B65H 39/10 270/58.27 |
| 7,976,007 | B2 * | 7/2011 | Collings | B65H 3/0676 271/4.03 |
| 8,505,906 | B2 * | 8/2013 | Kawachi | B65H 3/0676 271/119 |
| 9,272,859 | B2 * | 3/2016 | Sato | B65H 3/0669 |
| 10,179,715 | B2 * | 1/2019 | Mimoto | B65H 3/047 |

FOREIGN PATENT DOCUMENTS

| | | | |
|---|---|---|---|
| JP | 59022826 A | * | 6/1984 |
| JP | 03-249030 | | 11/1991 |

* cited by examiner

*Primary Examiner* — Patrick H Mackey
(74) *Attorney, Agent, or Firm* — AMIN, TUROCY & WATSON, LLP

(57) ABSTRACT

A sheet stacking part stacks sheets. A first roller applies a force in a conveyance direction to an uppermost sheet among sheets stacked on the sheet stacking part by rotating in a forward direction. A second roller is separated from the first roller on the downstream side in the conveyance direction. The second roller applies the force in the conveyance direction to the uppermost sheet by rotating in the forward direction. A controller controls rotation of the first roller and the second roller so that a second main operation is performed after a first main operation. The first main operation is an operation of rotating only the first roller of the first roller and the second roller in the forward direction. The second main operation is an operation of rotating both the first roller and the second roller in the forward direction.

19 Claims, 5 Drawing Sheets

IMAGE FORMING APPARATUS

FIELD

Embodiments described herein relate generally to an image forming apparatus and methods related thereto.

BACKGROUND

In a sheet supply device of the image forming apparatus, a sheet bundle in which a plurality of sheets are stacked is placed. The sheet supply device conveys sheets in the sheet bundle one by one. However, depending on a type of sheet, adhesion force between the sheets forming the sheet bundle may be strong. In that case, double feeding may occur when the sheet is conveyed.

DETAILED DESCRIPTION

Figure 1:
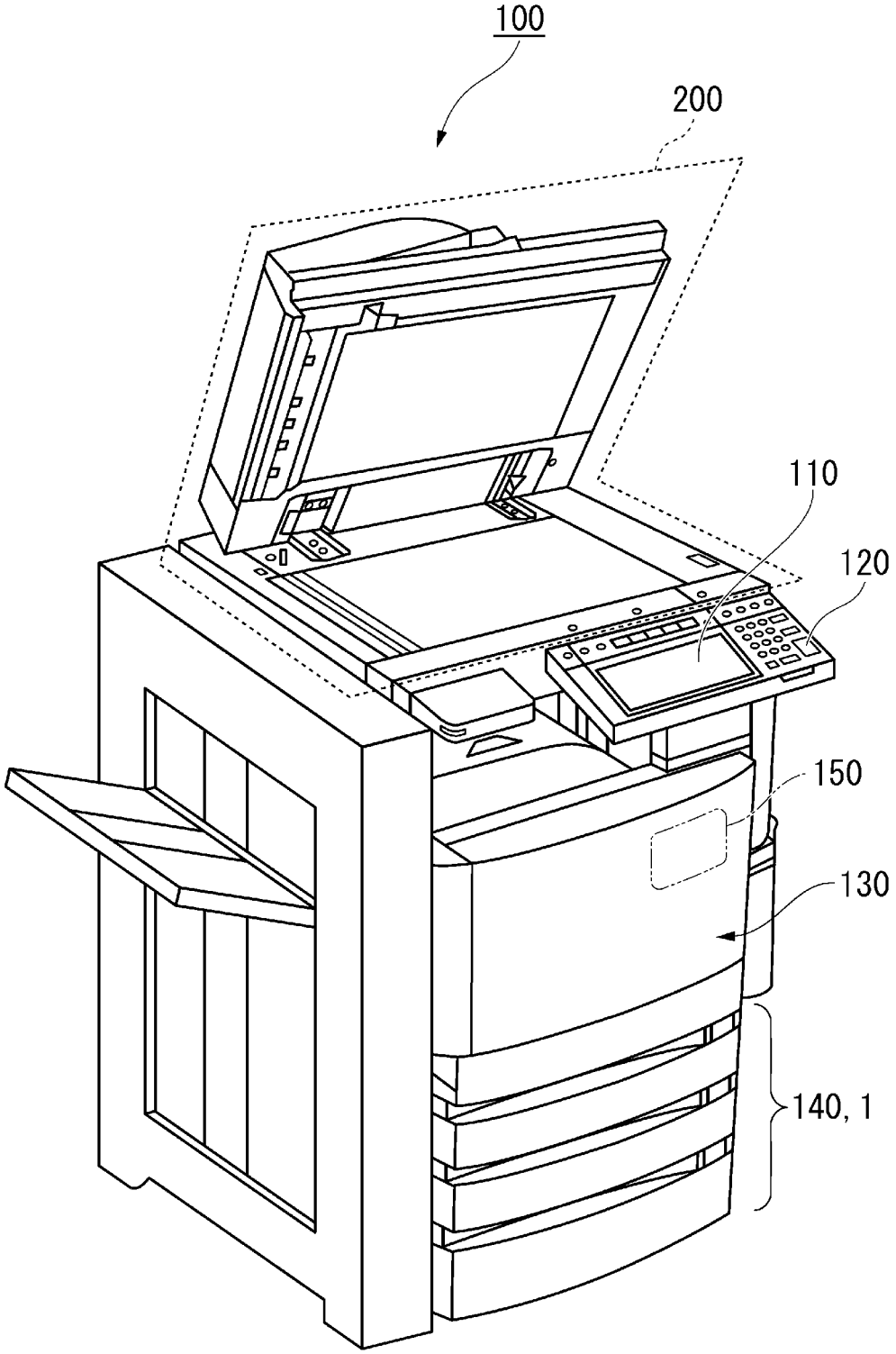
FIG. 1 illustrates a perspective view of a configuration example of an image forming apparatus of an embodiment.

In general, according to one embodiment, there is provided an image forming apparatus including a sheet stacking part, a first roller, a second roller, and a control unit. The sheet stacking part is configured to stack sheets. The first roller is configured to apply a force in a conveyance direction to an uppermost sheet among the sheets stacked on the sheet stacking part by rotating in a forward direction. The second roller is configured to be separated from the first roller on the downstream side in the conveyance direction. The second roller is configured to apply the force in the conveyance direction to the uppermost sheet by rotating in the forward direction. The control unit is configured to control rotation of the first roller and the second roller so that a second main operation is performed after a first main operation. The first main operation is an operation of rotating only the first roller of the first roller and the second roller in the forward direction. The second main operation is an operation of rotating both the first roller and the second roller in the forward direction. According to another embodiment, a method of handling a single sheet from a stack of sheets involves applying a force in a conveyance direction to the single sheet of the stack of sheets by rotating in a forward direction a first roller; applying a force in the conveyance direction to the single sheet by rotating in the forward direction a second roller, the second roller separated from the first roller on the downstream side in the conveyance direction; and rotating both the first roller and the second roller in the forward direction after rotating only the first roller of the first roller and the second roller in the forward direction.

Hereinafter, an image forming apparatus of an embodiment will be described with reference to the accompanying drawings. In each figure, the same reference numerals are given to the same configurations. The dimensions and shape of each member may be exaggerated or simplified.

As illustrated in FIG. 1, for example, an image forming apparatus 100 is a multifunction machine. The image forming apparatus 100 includes a display 110, a control panel 120, a printer unit 130, a sheet accommodation part 140, a control unit 150, and an image reading unit 200.

The image forming apparatus 100 forms an image on a sheet by using developer such as a toner. For example, the sheet is a sheet-like recording medium such as paper, label paper sheet, resin sheet, postcard, and envelope.

The display 110 is an image display device such as a liquid crystal display or an organic electro luminescence (EL) display. The display 110 displays various information about the image forming apparatus 100.

The control panel 120 includes a plurality of buttons. The control panel 120 receives an operation of a user. The control panel 120 outputs a signal corresponding to the operation performed by the user to the control unit 150. The display 110 and the control panel 120 may be configured as an integrated touch panel.

The printer unit 130 forms an image on the sheet based on image information generated by the image reading unit 200 or image information received via a communication path. For example, the printer unit 130 forms an image by the following processing. The printer unit 130 forms an electrostatic latent image on a photoreceptor drum based on the image information. The printer unit 130 forms a visible image by adhering developer to the electrostatic latent image. The printer unit 130 is an image forming unit.

For example, the developer is a toner. A transfer unit of the printer unit 130 transfers the visible image onto the sheet. A fixing unit of the printer unit 130 fixes the visible image onto the sheet by heating and pressurizing the sheet.

The printer unit 130 may be a device for fixing the toner image or an ink jet type device.

The sheet accommodation part 140 accommodates a sheet used for image formation in the printer unit 130. The sheet accommodation part 140 conveys the sheet toward the printer unit 130. The sheet accommodation part 140 configures a sheet supply device 1. The sheet feeding device 1 is also referred to as a paper feed device.

The image reading unit 200 reads image information targeted for reading based on brightness and darkness of light. The image reading unit 200 records the read image information. The recorded image information may be transmitted to another information processing device via a network. The recorded image information may be image-formed on the sheet by the printer unit 130.

Figure 2:
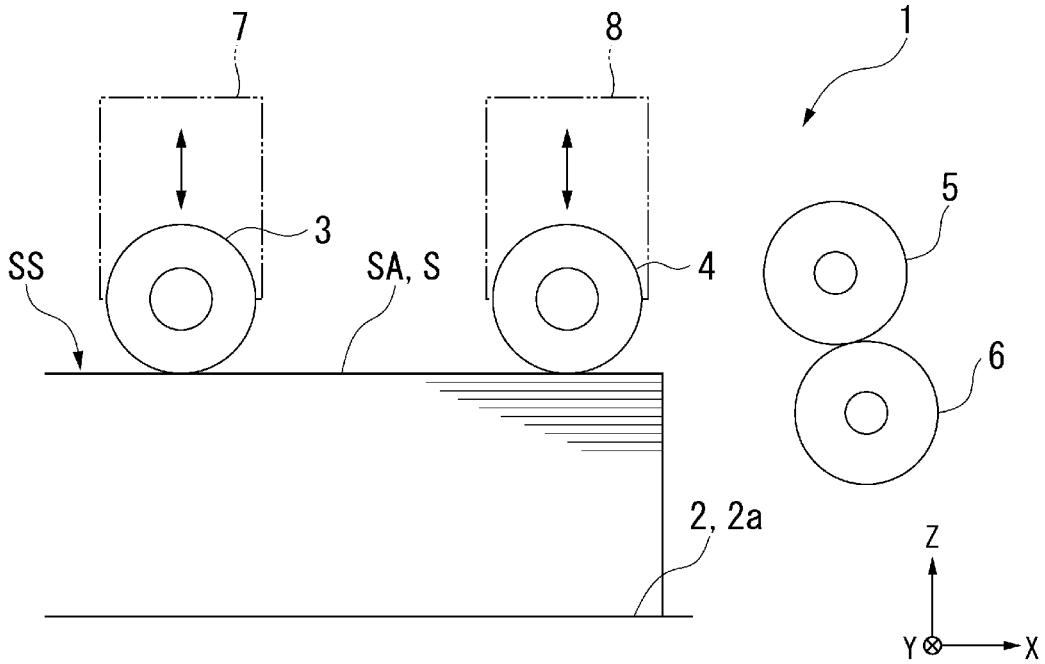
FIG. 2 illustrates a configuration diagram of a sheet supply device.

As illustrated in FIG. 2, the sheet supply device 1 includes a sheet stacking part 2, a first roller 3, a second roller 4, a paper feed roller 5, and a separation roller 6.

The sheet stacking part 2 can stack a sheet bundle SS. The top surface of the sheet stacking part 2 is a placement surface 2*a* on which the sheet bundle SS is placed. The sheet bundle SS is formed by stacking a plurality of sheets S.

An XYZ-Cartesian coordinate system is adopted as a local coordinate system of the sheet stacking part 2. The X-direction is a direction parallel to the placement surface 2*a* of the sheet stacking part 2. The +X-direction is a sheet conveyance direction. The +X-direction is also referred to as the "downstream side". The Y-direction is parallel to the placement surface 2*a* and orthogonal to the X-direction. The Y-direction is a width direction of the sheet S. The Z-direction is a direction perpendicular to the placement surface 2*a* of the sheet stacking part 2. The +Z-direction is the direction in which the sheets S are piled up on the placement surface 2*a*. For example, the +Z-direction is a height direction. The +Z-direction is an upward direction. The position in the Z-direction is also referred to as the height position.

The first roller 3 and the second roller 4 include a rotating shaft parallel to the Y-direction. The first roller 3 and the second roller 4 can come into contact with a top surface of a sheet S at the top of the sheet bundle SS placed on the sheet stacking part 2. The sheet S at the top of the sheet bundle SS is an uppermost sheet SA. The first roller 3 and the second roller 4 apply a force in the +X-direction to the uppermost sheet SA by rotating in a forward direction. The first roller 3 and the second roller 4 convey the uppermost sheet SA in the +X-direction. In FIG. 2, the forward direction of the first roller 3 and the second roller 4 is a counterclockwise direction. The first roller 3 and the second roller 4 are pickup rollers. The first roller 3 and the second roller 4 are also referred to as "rollers 3 and 4".

The first roller 3 can be displaced in the Z-direction by a first elevating mechanism 7. For example, the first elevating mechanism 7 includes an electronic device such as a solenoid and a mechanical link mechanism. The first elevating mechanism 7 may include a support that supports the first roller 3 and a drive source that displaces the first roller 3 in the Z-direction. The first roller 3 can approach and separate from the sheet stacking part 2 by being displaced in the Z-direction.

The second roller 4 can be displaced in the Z-direction by a second elevating mechanism 8. For example, the second elevating mechanism 8 includes an electronic device such as a solenoid and a mechanical link mechanism. The second elevating mechanism 8 may include a support that supports the second roller 4 and a drive source that displaces the second roller 4 in the Z-direction. The second roller 4 can approach and separate from the sheet stacking part 2 by being displaced in the Z-direction.

The second roller 4 is separated from the first roller 3 on the downstream side. The second roller 4 is positioned near an end of the sheet stacking part 2 in the +X-direction when viewed from a direction parallel to the Z-direction.

An outer diameter of the first roller 3 is desirably equal to an outer diameter of the second roller 4. If the outer diameter of the first roller 3 and the outer diameter of the second roller 4 are equal, transfer speeds of the sheet S by the rollers 3 and 4 become the same if rotational speeds of the rollers 3 and 4 are the same, and thus operation control of the rollers 3 and 4 becomes easy.

The first roller 3 and the second roller 4 are rotationally driven independently. The first roller 3 and the second roller 4 can be rotationally driven independently of each other by being respectively rotated and driven by a dedicated drive source. For example, the first roller 3 is rotationally driven by a first drive source. The second roller 4 is rotationally driven by a second drive source different from the first drive source. For example, the first drive source and the second drive source are motors. According to the configuration in which the rollers 3 and 4 are rotationally driven by different drive sources, when rotation conditions of the rollers 3 and 4 are different, the rotation conditions of the rollers 3 and 4 can be easily set.

In order to rotationally drive the first roller 3 and the second roller 4 independently, the following drive mechanism may be adopted. The drive mechanism includes one drive source, a drive force transmission unit, a first clutch, and a second clutch. The drive source can drive one or both of the first roller 3 and the second roller 4 via the drive force transmission unit. The first clutch can switch connection and disconnection between the drive source and the first roller 3. The first clutch transmits a drive force of the drive source to the first roller 3 in a connected state. The first clutch does not transmit the drive force of the drive force to the first roller 3 in a disconnected state. The second clutch can switch connection and disconnection between the drive source and the second roller 4. The second clutch transmits the drive force of the drive force to the second roller 4 in the connected state. The second clutch does not transmit the drive force of the drive force to the second roller 4 in the disconnected state. This drive mechanism has a simple structure because the drive mechanism has only one drive source.

The paper feed roller 5 and the separation roller 6 have a rotating shaft parallel to the Y-direction. The paper feed roller 5 is a drive roller and conveys the sheet S at the same speed as the pickup roller 3. The paper feed roller 5 is driven by a drive source such as a motor.

The separation roller 6 is a driven roller linked to the paper feed roller 5.

The paper feed roller 5 and the separation roller 6 further convey the sheet S carried out from the sheet stacking part 2 with the sheet S pinched between nips.

The control unit 150 (see FIG. 1) controls the rotation of the first roller 3 and the second roller 4 by controlling the operation of the drive source. For example, the control unit 150 can control the drive and stop of the first roller 3 and the second roller 4. The control unit 150 can control the rotational speeds of the first roller 3 and the second roller 4.

The control unit 150 can adjust a load applied to the sheet S by the first roller 3 by determining a height position of the first roller 3 by using the first elevating mechanism 7. The control unit 150 can adjust the load applied to the sheet S by the second roller 4 by determining the height position of the second roller 4 by using the second elevating mechanism 8.

The load of the first roller 3 to the sheet S is F1[N]. A coefficient of dynamic friction of the first roller 3 to the sheet S is $\mu_{DP}$1 [−]. The load of the second roller 4 to the sheet S is F2[N]. A coefficient of static friction of the second roller 4 to the sheet S is $\mu_{SP}$2[−]. The load F1, the dynamic friction coefficient $\mu_{DP}$1, the load F2, and the static friction coefficient $\mu_{SP}$2 preferably satisfy the following equation (1).

$$F1\times\mu_{DP}1<F2\times\mu_{SP}2 \quad (1)$$

Figure 4:
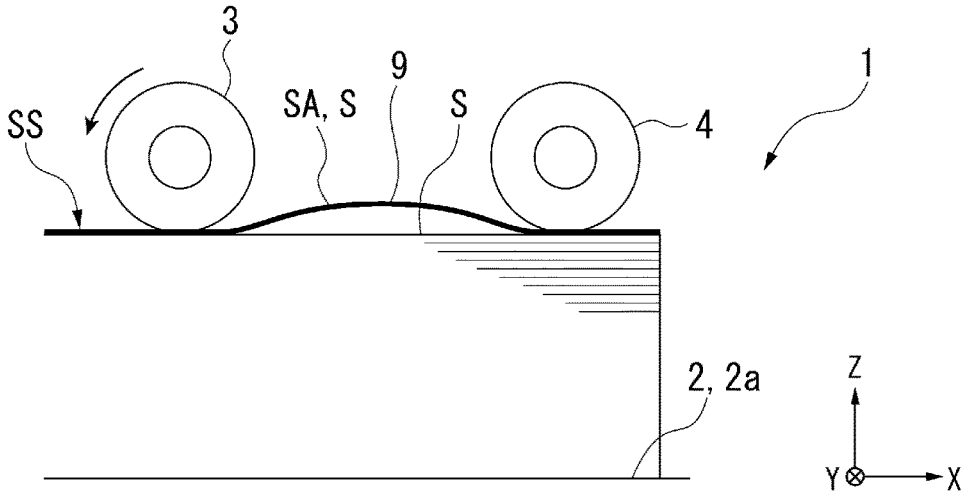
FIG. 4 illustrates a process chart for describing the operation of the sheet supply device.

When the equation (1) is satisfied, the second roller 4 has a high function of regulating movement of the sheet S, and thus a deflection is easily formed in the sheet S in a first main operation A1 (see FIG. 4). For example, the dynamic friction coefficient and the static friction coefficient can be measured by a method conforming to JIS K7125 (1999).

Next, the operation of the image forming apparatus 100 will be described.

As illustrated in FIG. 2, the sheet stacking part 2 stacks the sheet bundle SS. In FIG. 2, the first roller 3 and the second roller 4 come into contact with the top surface of the uppermost sheet SA of the sheet bundle SS.

Figure 3:
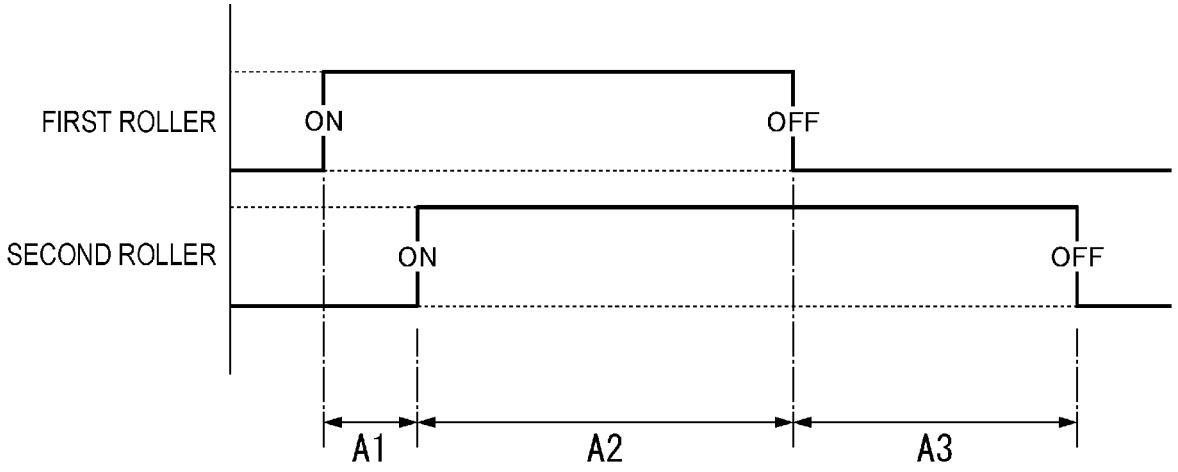
FIG. 3 illustrates a diagram for describing a first mode of an operation of the sheet supply device.

FIG. 3 is a diagram illustrating a first mode of the operation of the sheet supply device 1.

As illustrated in FIG. 3, the control unit 150 (see FIG. 1) performs the first main operation A1, a second main operation A2, and a third main operation A3 in this order. Hereinafter, the first main operation A1, the second main operation A2, and the third main operation A3 will be described. In FIG. 3, the start of operation of the first roller 3 and the second roller 4 is indicated as "ON". The stoppage of operation of the first roller 3 and the second roller 4 is indicated as "OFF".

As illustrated in FIG. 4, in the first main operation A1, the control unit 150 rotates only the first roller 3 of the first roller 3 and the second roller 4 in the forward direction. In other words, the control unit 150 rotates the first roller 3 in the forward direction and puts the second roller 4 in a stopped state.

The first roller 3 applies a force to the downstream side to the uppermost sheet SA. Since the second roller 4 is in the stopped state, the uppermost sheet SA is regulated from moving to the downstream side. The first roller 3 forms a deflection in a portion between a spot where the first roller 3 contacts and a spot where the second roller 4 contacts, of the uppermost sheet SA. The portion where the deflection occurs is referred to as a deflection portion 9. The deflection portion 9 separates from the other sheet S. The adhesion force between the deflection portion 9 and the other sheet S is reduced.

The control unit 150 can adjust the time of the first main operation A1 according to the type of the sheet S. Since the sheet S has different thickness, surface condition, mass, mechanical characteristics, and the like depending on the type, the control unit 150 can adjust the time of the first main operation A1 according to the thickness, surface condition, mass, mechanical characteristics, and the like of the sheet S.

For example, since a thick sheet S (for example, thick paper) is difficult to adhere to another sheet S during stacking, the time of the first main operation A1 may be shortened when the thick sheet S is used. The time of the first main operation A1 may be zero. Since the sheet S having a large surface roughness easily adheres to another sheets S during stacking, the time of the first main operation A1 can be lengthened.

Figure 5:
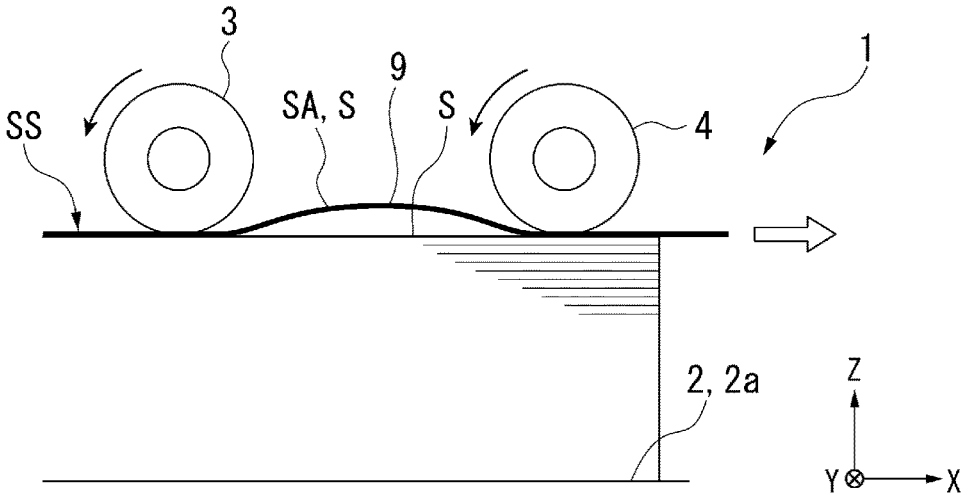
FIG. 5 illustrates a process chart following FIG. 4.

As illustrated in FIG. 3, the control unit 150 performs the second main operation A2 after the first main operation A1. As illustrated in FIG. 5, in the second main operation A2, the control unit 150 rotates both the first roller 3 and the second roller 4 in the forward direction. The first roller 3 and the second roller 4 apply the force to the downstream side to the uppermost sheet SA to convey the uppermost sheet SA to the downstream side. The first roller 3 and the second roller 4 guide the uppermost sheet SA between the paper feed roller 5 and the separation roller 6 (see FIG. 2). The rotational speed of the first roller 3 and the rotational speed of the second roller 4 are preferably the same.

The first main operation A1 and the second main operation A2 are operations in which the second roller 4 starts rotating with a delay after the start of rotation of the first roller 3.

Figure 6:
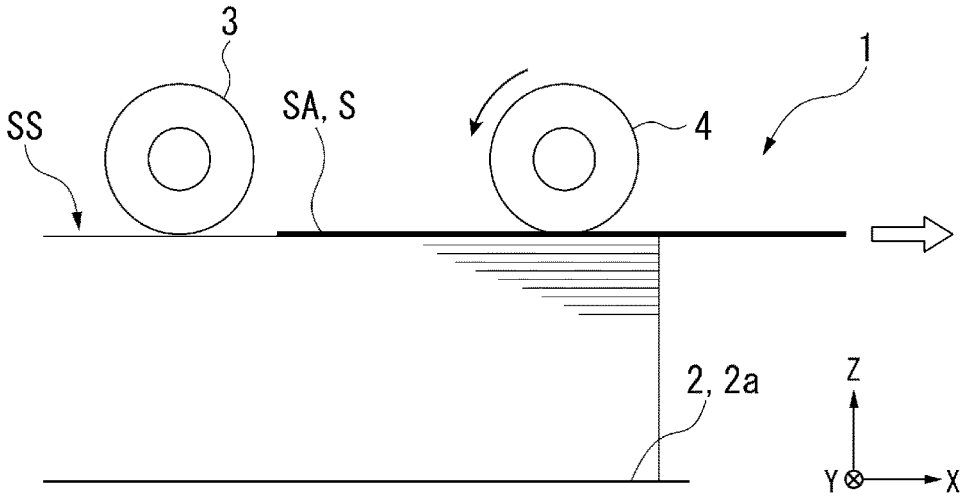
FIG. 6 illustrates a process chart following FIG. 5.

As illustrated in FIG. 3, the control unit 150 performs the third main operation A3 after the second main operation A2. As illustrated in FIG. 6, in the third main operation A3, the control unit 150 rotates only the second roller 4 of the first roller 3 and the second roller 4 in the forward direction. In other words, the control unit 150 stops the first roller 3 and rotates the second roller 4 in the forward direction.

The third main operation A3 is preferably started before the uppermost sheet SA leaves the first roller 3. Since the first roller 3 is stopped by the start of the third main operation A3, force in the conveying direction is not applied to the exposed second sheet S, and the second sheet S can be held at a predetermined position.

The second roller 4 applies the force to the downstream side to the uppermost sheet SA, and conveys the uppermost sheet SA to the downstream side. The control unit 150 stops the rotation of the second roller 4 after the uppermost sheet SA is separated from the second roller 4.

As illustrated in FIG. 2, the paper feed roller 5 and the separation roller 6 further convey the sheet S with the sheet S pinched between the nips. The sheet S goes to the printer unit 130 (see FIG. 1).

In the image forming apparatus 100, a deflection occurs in the uppermost sheet SA in the first main operation A1. Since the uppermost sheet SA (deflection portion 9) having a deflected portion is separated from the other sheet S, adhesion force between the uppermost sheet SA and the other sheet S is reduced. Since the adhesion force between the uppermost sheet SA and another sheet S can be reduced, double feeding of the sheet S can be suppressed.

In the mode illustrated in FIG. 3, the control unit 150 stops the first roller 3 in the third main operation A3, but the first roller 3 does not need to be stopped. In the third main operation A3, the control unit 150 may raise the first roller 3 while rotating and driving to separate the first roller 3 from the uppermost sheet SA.

Figure 7:
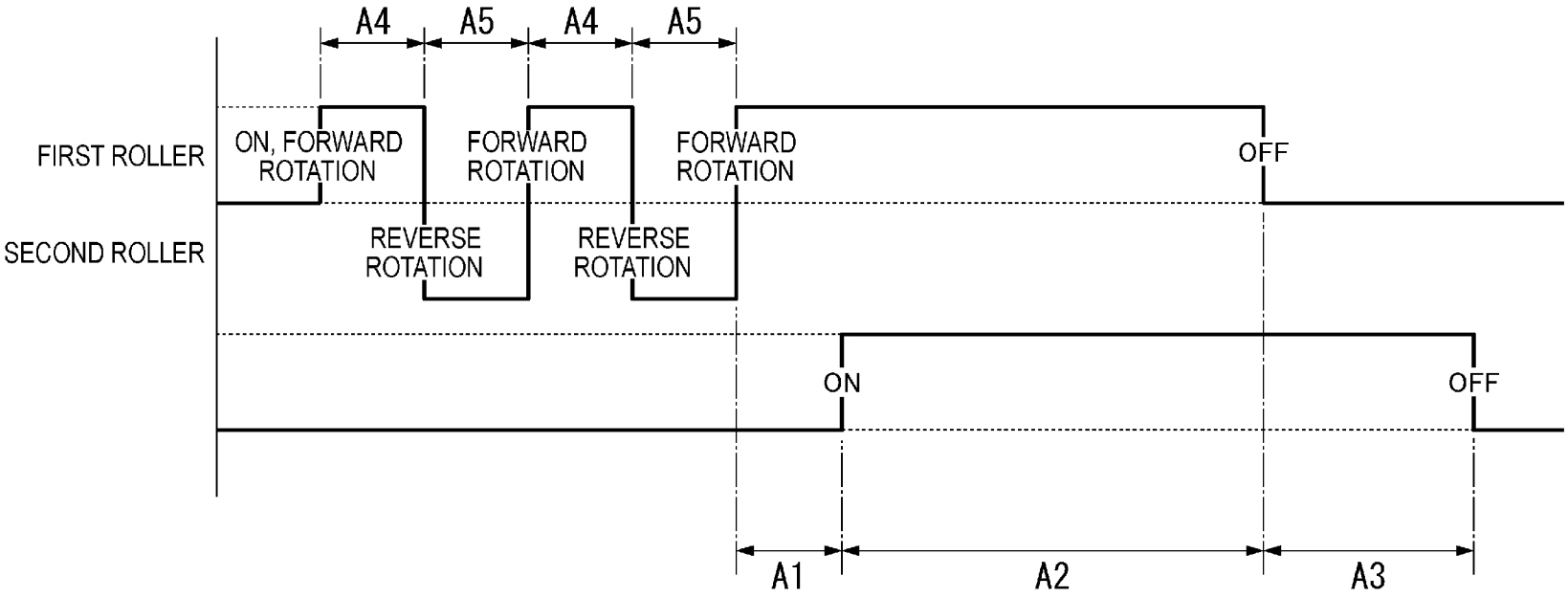
FIG. 7 illustrates a diagram for describing a second mode of the operation of the sheet supply device.

FIG. 7 is a diagram illustrating a second mode of the operation of the sheet supply device 1.

As illustrated in FIG. 7, in the second mode, the control unit 150 (see FIG. 1) performs at least one set of a first preliminary operation A4 and a second preliminary operation A5 prior to the first main operation A1. In the example illustrated in FIG. 7, the control unit 150 performs two sets of the first preliminary operation A4 and the second preliminary operation A5 prior to the first main operation A1. In other words, the control unit 150 performs the first preliminary operation A4, the second preliminary operation A5, the first preliminary operation A4, and the second preliminary operation A5 in this order, and then performs the first main operation A1, the second main operation A2, and the third main operation A3. Hereinafter, the first preliminary operation A4 and the second preliminary operation A5 will be described.

Figure 8:
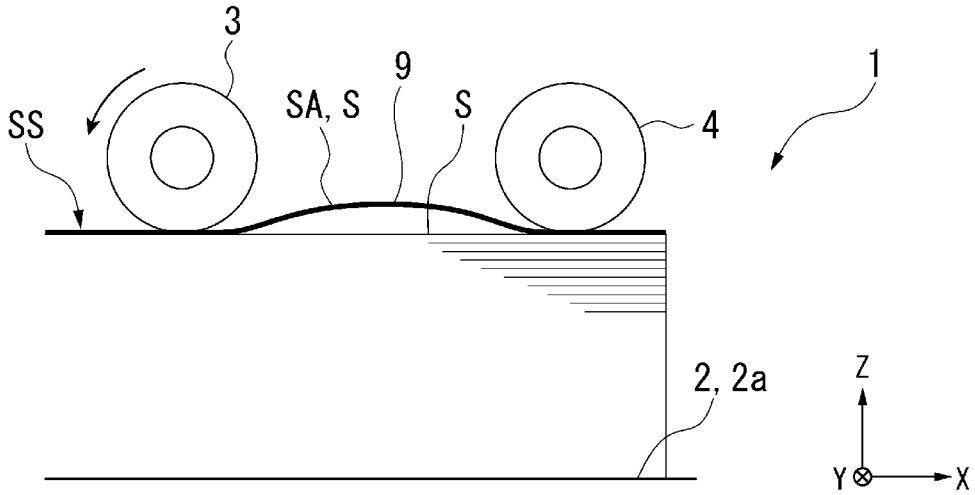
FIG. 8 illustrates a process chart for describing a first example of a second preliminary operation.

As illustrated in FIG. 8, in the first preliminary operation A4, the control unit 150 rotates only the first roller 3 of the first roller 3 and the second roller 4 in the forward direction. In FIG. 7, the rotation in the forward direction is described as "forward rotation". The first roller 3 applies the force to the downstream side to the uppermost sheet SA. Since the second roller 4 is in the stopped state, the uppermost sheet SA is regulated from moving to the downstream side. The first roller 3 forms the deflection portion 9 on the uppermost sheet SA. The adhesion force between the deflection portion 9 and the other sheet S is reduced.

As illustrated in FIG. 7, the control unit 150 can set the time of the first preliminary operation A4 according to the type of the sheet S. For example, the control unit 150 can set the time of the first preliminary operation A4 according to the thickness, surface condition, mass, mechanical characteristics, and the like of the sheet S.

The control unit 150 performs the second preliminary operation A5 after the first preliminary operation A4. Examples of the second preliminary operation A5 may include a first example and a second example.

Figure 9:
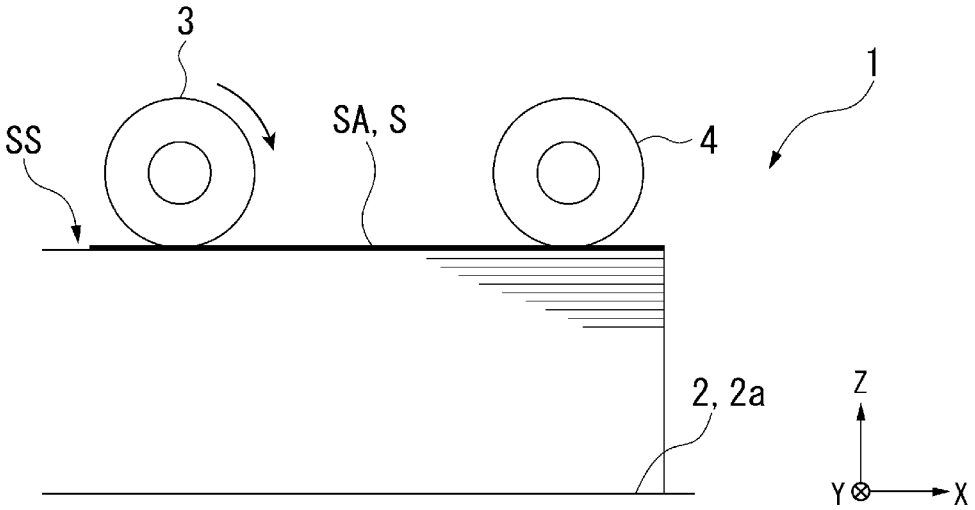
FIG. 9 illustrates a process chart following FIG. 8.

As illustrated in FIG. 9, in the first example, the control unit 150 rotates only the first roller 3 of the first roller 3 and the second roller 4 in a reverse direction. The "reverse direction" is the direction opposite to the forward direction. In FIG. 7, the rotation in the reverse direction is described as "reverse rotation". Since the first roller 3 moves the uppermost sheet SA to the upstream side, the deflection of the uppermost sheet SA is eliminated.

In the second example, the control unit 150 reduces the load to the uppermost sheet SA only with respect to the first roller 3 of the first roller 3 and the second roller 4. In order to reduce the load of the first roller 3, a height position of the first roller 3 may be adjusted by the first elevating mechanism 7. As the load of the first roller 3 is lowered, regulation by the first roller 3 is weakened, so that a part of the uppermost sheet SA can move to the upstream side, and the deflection is eliminated.

As illustrated in FIG. 7, the control unit 150 performs the first preliminary operation A4 for the second time and the second preliminary operation A5 for the second time.

Next, the control unit 150 performs the first main operation A1, the second main operation A2, and the third main operation A3 in this order (see FIG. 3 to FIG. 5).

In the image forming apparatus 100, since at least one set of the first preliminary operation A4 and the second preliminary operation A5 is performed prior to the first main operation A1, the adhesion force between the uppermost sheet SA and another sheet S can be further reduced. Since the adhesion force between the uppermost sheet SA and another sheet S can be reduced, double feeding of the sheet S can be suppressed.

In the example illustrated in FIG. 7, although two sets of the first preliminary operation A4 and the second preliminary operation A5 are performed, the number of sets of the first preliminary operation A4 and the second preliminary operation A5 is not particularly limited. The number of sets of the first preliminary operation A4 and the second preliminary operation A5 may be one or a plurality (any number of two or more).

The control unit 150 can set the number of times of the first preliminary operation A4 and the second preliminary operation A5 according to the type of the sheet S. For example, if the sheet S is a first type of sheet, the number of the first preliminary operation A4 and the second preliminary operation A5 can be set as the first number of times. If the sheet S is of a second type of sheet, the number of the first preliminary operation A4 and the second preliminary operation A5 can be set as the second number of times. The second type of the sheet is different from the first type of the sheet. The second number of times is different from the first number of times. The control unit 150 can set the number of times of the first preliminary operation A4 and the second preliminary operation A5 according to the thickness, surface condition, mass, mechanical characteristics, and the like of the sheet S.

According to at least one embodiment described above, in the first main operation A1, the deflection occurs in the uppermost sheet SA. Since the uppermost sheet SA having the deflected portion is separated from the other sheet S, the adhesion force between the uppermost sheet SA and another sheet S is reduced. Since the adhesion force between the uppermost sheet SA and the other sheet S can be reduced, double feeding of the sheet S can be suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a sheet stacking part on which to stack sheets;

a first roller configured to apply a force in a conveyance direction to an uppermost sheet of the sheets stacked on the sheet stacking part by rotating in a forward direction;

a second roller configured to be separated from the first roller on the downstream side in the conveyance direction and apply the force in the conveyance direction to the uppermost sheet by rotating in the forward direction; and a controller configured to control rotation of the first roller and the second roller so that a second main operation of rotating both the first roller and the second roller in the forward direction is performed after a first main operation of rotating only the first roller of the first roller and the second roller in the forward direction, and wherein the controller is configured to adjust a time of the first main operation according to a type of the uppermost sheet.

2. The image forming apparatus according to claim 1, wherein a load F1 of the first roller on the uppermost sheet, a dynamic friction coefficient μDP1 of the first roller on the uppermost sheet, a load F2 of the second roller on the uppermost sheet, and a static friction coefficient μSP2 of the second roller on the uppermost sheet satisfy the following equation:

$$F1\times\mu DP1<F2\times\mu SP2.$$

3. The image forming apparatus according to claim 1, wherein the controller is configured to perform, prior to the first main operation, at least one of:

a first preliminary operation of rotating only the first roller of the first roller and the second roller in the forward direction, and a second preliminary operation of rotating only the first roller of the first roller and the second roller in a reverse direction opposite to the forward direction, after the first preliminary main operation.

4. The image forming apparatus according to claim 3, wherein the controller is configured to adjust a time of the first preliminary operation according to a type of the uppermost sheet.

5. The image forming apparatus according to claim 3, wherein the controller is configured to set a number of the first preliminary operation and the second preliminary operation as a first number of times if the uppermost sheet is of a first type, and set a number of the first preliminary operation and the second preliminary operation as a second number of times if the uppermost sheet is of a second type.

6. The image forming apparatus according to claim 1, wherein the controller is configured to perform, prior to the first main operation, at least one of:

a first preliminary operation of rotating only the first roller of the first roller and the second roller in the forward direction, and a second preliminary operation of reducing a load on the uppermost sheet only for the first roller of the first roller and the second roller, after the first preliminary operation.

7. The image forming apparatus according to claim 1, wherein the controller is configured to perform a third main operation of rotating only the second roller of the first roller and the second roller in the forward direction, after the second main operation.

8. The image forming apparatus according to claim 7, wherein the controller is configured to start the third main operation before the uppermost sheet leaves the first roller by the second main operation.

9. A method of handling a single sheet from a stack of sheets, comprising:

applying a force in a conveyance direction to the single sheet of the stack of sheets by rotating in a forward direction a first roller;

applying a force in the conveyance direction to the single sheet by rotating in the forward direction a second roller, the second roller separated from the first roller on the downstream side in the conveyance direction; and rotating both the first roller and the second roller in the forward direction after rotating only the first roller of the first roller and the second roller in the forward direction; and adjusting a time of rotating only the first roller of the first roller and the second roller in the forward direction according to a type of the single sheet.

10. The method according to claim 9, wherein a load F1 of the first roller on the single sheet, a dynamic friction coefficient μDP1 of the first roller on the single sheet, a load F2 of the second roller on the single sheet, and a static friction coefficient μSP2 of the second roller on the single sheet satisfy the following equation:

$$F1\times\mu DP1<F2\times\mu SP2.$$

11. The method according to claim 9, further comprising:

prior to rotating only the first roller of the first roller and the second roller in the forward direction, at least one of:

rotating only the first roller of the first roller and the second roller in the forward direction, and rotating only the first roller of the first roller and the second roller in a reverse direction opposite to the forward direction, after rotating only the first roller of the first roller and the second roller in the forward direction.

12. The method according to claim 11, further comprising:

adjusting a time of rotating only the first roller of the first roller and the second roller in the forward direction according to a type of the single sheet.

13. The method according to claim 11, further comprising:

setting a number of rotating only the first roller of the first roller and the second roller in the forward direction and rotating only the first roller of the first roller and the second roller in a reverse direction opposite to the forward direction as a first number of times if the single sheet is of a first type, and setting a number of the rotating only the first roller of the first roller and the second roller in the forward direction and rotating only the first roller of the first roller and the second roller in a reverse direction opposite to the forward direction as a second number of times if the single sheet is of a second type.

14. The method according to claim 9, further comprising:

prior to rotating only the first roller of the first roller and the second roller in the forward direction, at least one of:

rotating only the first roller of the first roller and the second roller in the forward direction, and reducing a load on the single sheet only for the first roller of the first roller and the second roller, after rotating only the first roller of the first roller and the second roller in the forward direction.

15. The method according to claim 9, further comprising:

rotating only the second roller of the first roller and the second roller in the forward direction, after rotating both the first roller and the second roller in the forward direction.

16. The method according to claim 15, further comprising:

starting rotating only the second roller of the first roller and the second roller in the forward direction before the single sheet leaves the first roller by rotating both the first roller and the second roller in the forward direction.

17. The method according to claim 9, with the priviso that the single sheet does not comprise two sheets.

18. An image forming apparatus, comprising:

a sheet stacking part on which to stack sheets;

a first roller configured to apply a force in a conveyance direction to an uppermost sheet of the sheets stacked on the sheet stacking part by rotating in a forward direction;

a second roller configured to be separated from the first roller on the downstream side in the conveyance direction and apply the force in the conveyance direction to the uppermost sheet by rotating in the forward direction; and a controller configured to control rotation of the first roller and the second roller so that a second main operation of rotating both the first roller and the second roller in the forward direction is performed after a first main operation of rotating only the first roller of the first roller and the second roller in the forward direction, wherein the controller is configured to perform, prior to the first main operation, at least one of:

a first preliminary operation of rotating only the first roller of the first roller and the second roller in the forward direction, and a second preliminary operation of rotating only the first roller of the first roller and the second roller in a reverse direction opposite to the forward direction, after the first preliminary main operation, and wherein the controller is configured to adjust a time of the first preliminary operation according to a type of the uppermost sheet.

19. An image forming apparatus, comprising:

a sheet stacking part on which to stack sheets;

a first roller configured to apply a force in a conveyance direction to an uppermost sheet of the sheets stacked on the sheet stacking part by rotating in a forward direction;

a second roller configured to be separated from the first roller on the downstream side in the conveyance direction and apply the force in the conveyance direction to the uppermost sheet by rotating in the forward direction; and a controller configured to control rotation of the first roller and the second roller so that a second main operation of rotating both the first roller and the second roller in the forward direction is performed after a first main operation of rotating only the first roller of the first roller and the second roller in the forward direction, wherein the controller is configured to perform, prior to the first main operation, at least one of:

a first preliminary operation of rotating only the first roller of the first roller and the second roller in the forward direction, and a second preliminary operation of rotating only the first roller of the first roller and the second roller in a reverse direction opposite to the forward direction, after the first preliminary main operation, and wherein the controller is configured to set a number of the first preliminary operation and the second preliminary operation as a first number of times if the uppermost sheet is of a first type, and set a number of the first preliminary operation and the second preliminary operation as a second number of times if the uppermost sheet is of a second type.

* * * * *